US006185756B1

(12) United States Patent
Roesler et al.

(10) Patent No.: US 6,185,756 B1
(45) Date of Patent: Feb. 13, 2001

(54) HAND SPRINKLING ROSE

(76) Inventors: Heidrun Roesler; Siegfried Roesler, both of Am Hempel 7, D-02742, Friedersdorf (DE)

( * ) Notice: Under 35 U.S.C. 154(b), the term of this patent shall be extended for 0 days.

(21) Appl. No.: 09/269,957

(22) PCT Filed: Oct. 16, 1997

(86) PCT No.: PCT/DE97/02375

§ 371 Date: Apr. 8, 1999

§ 102(e) Date: Apr. 8, 1999

(87) PCT Pub. No.: WO98/17398

PCT Pub. Date: Apr. 30, 1998

(30) Foreign Application Priority Data

Oct. 19, 1996 (DE) ..... 196 43 223

(51) Int. Cl.[7] ..... A45D 19/00
(52) U.S. Cl. ..... 4/515; 4/567; 4/615; 239/557
(58) Field of Search ..... 4/515, 517, 518, 4/567, 568, 569, 615–618; 239/557, 566

(56) References Cited

U.S. PATENT DOCUMENTS

| | | | | |
|---|---|---|---|---|
| 1,948,807 | | 2/1934 | Taylor . | |
| 2,288,590 | * | 7/1942 | McClure et al. | 4/515 |
| 2,874,001 | | 2/1959 | Webb . | |
| 4,590,628 | * | 5/1986 | DeGregorio | 4/615 |
| 4,607,795 | | 8/1986 | Ettlinger et al. . | |
| 5,058,220 | * | 10/1991 | Mikiya | 4/615 |
| 5,311,621 | * | 5/1994 | Tung | 4/615 |
| 5,339,469 | * | 8/1994 | Gilles | 4/601 |

FOREIGN PATENT DOCUMENTS

| | | | |
|---|---|---|---|
| 2249465 | | 4/1974 | (DE) . |
| 2451715 | | 5/1976 | (DE) . |
| 2505970 | | 8/1976 | (DE) . |
| 7635181 | | 3/1977 | (DE) . |
| 3003784 | | 8/1980 | (DE) . |
| 3044310 | | 6/1982 | (DE) . |
| 34025450 | | 8/1985 | (DE) . |
| 3706320 | | 3/1988 | (DE) . |
| 4033364 | | 3/1991 | (DE) . |
| 3943062 | | 7/1991 | (DE) . |
| 93123345 | | 12/1993 | (DE) . |
| 4236037 | | 4/1994 | (DE) . |
| 0235487 | | 9/1987 | (EP) . |
| 1496235 | | 8/1967 | (FR) . |
| 2313132 | | 12/1976 | (FR) . |
| 2218926 | * | 11/1989 | (GB) . |
| 03045203 | | 2/1991 | (JP) . |

* cited by examiner

*Primary Examiner*—Henry J. Recla
*Assistant Examiner*—Tuan Nguyen
(74) *Attorney, Agent, or Firm*—Jordan and Hamburg LLP

(57) ABSTRACT

A hand-held sprinkling rose for washing hair includes a sprinkling head having outlet openings disposed substantially linearly in a number of rows ranging from one to five. The outlet openings have a diameter between 0.2 and 0.8 mm and the outlet openings are spaced apart 2 to 5 mm. The outlet openings are formed such that water streams are ejected which do not mix with one another before reaching a work plane at least 20 centimeters from the sprinkling head.

16 Claims, 3 Drawing Sheets

HAND SPRINKLING ROSE

BACKGROUND OF THE INVENTION

The present invention relates to a hand-held sprinkling rose, which is intended especially for washing hair and from which a liquid cleansing agent, such as water, emerges from nozzles in a sprinkling rose head of the hand-held sprinkling rose at a relatively high velocity.

According to the state of the art, hand-held sprinkling roses with different nozzle configurations are known.

The German patent DE 37 06 320 A1, for example, discloses a sprinkling rose head, which is intended for alternate emission of water jets of different types. The sprinkling rose head has a plurality of package-like, ring cylindrical control elements, which are combined in a concentric and mutually coaxial arrangement and which together define and limit a plurality of passage openings for emitting an equally large number of water jets. At least one of these control elements can be rotated manually about a common center axis of the overall arrangement of control elements in order to divert the water, arriving through one of the supplying openings in accordance with a desired jet shape, in the direction of at least one of the passage openings.

The German patent DE 40 33 364 A1 discloses a hand-held sprinkling rose with an integrated interrupter and a variable shower jet. A region of water outlet openings in a head part has a rectangular surface. Outlet openings can be opened or closed to different degrees with a control part in the head part.

Essentially, all sprinkling rose heads of the state of the art have concentric and two-dimensionally disposed outlet openings, the total surface area, in which the outlet openings are disposed, varying in size. In many cases, it is possible to choose between a very soft jet and circularly disposed outlet openings for a harder jet. Even for the latter configuration, the two-dimensional character of the water outlet is retained.

It is a disadvantage of the state of the art devices discussed above that the water consumption for almost all sprinkling roses is relatively high even when water-stopping devices are used.

According to the state of the art, sprinkling rose devices are also known (for example, from the German Offenlegungsschrift 30 44 310), which generally have, as so-called whole body showers, vertical frames, in which outlet openings, directed radially towards an interior of the shower device, are disposed linearly.

For industrial purposes, different sprinkling roses are known with a linear arrangement of outlet openings, mostly for the purpose of producing a liquid curtain.

For example, the German disclosure DE 93 12 334 U1 discloses a coolant sprinkling rose, especially for a machine tool, or the like, with an outlet element for coolant, wherein outlet openings are disposed essentially in rows. The disclosed device is based on the objective of supplying a moving tool with sufficient coolant at each place where the tool is used.

SUMMARY OF THE INVENTION

It is an object of the invention to provide a hand-held sprinkling rose, especially for washing hair, which decreases water consumption while, at the same time, improves a cleaning effect significantly. The hand-held sprinkling rose shall also be suitable for other handicraft and industrial cleaning tasks.

Pursuant to the invention, this objective is accomplished by providing a handheld sprinkling rose for washing hair, with a sprinkling rose head, in which outlet openings for the water are disposed essentially linearly, wherein the outlet openings are disposed in one to five rows, a diameter of the outlet openings is between 0.2 and 2 mm and a distance of outlet openings from one another is 2 to 5 mm, and the outlet openings are constructed in such a manner that water jets are formed which leave the outlet openings at a high velocity and which substantially do not mix with one another before they reach a work plane in which water treatment takes place.

A feature of the invention includes the outlet openings having a diameter between 0.3 and 0.8 mm. Another aspect of the invention includes the outlet openings being disposed in two rows.

A further feature includes the outlet openings of being in several rows disposed in along an axes which are at right angles to longitudinal axes of the rows or at an angle to the longitudinal axes. Optionally, the length of the rows is 20 to 100 mm.

The present invention further includes the feature of providing the above hand-held sprinkling rose with a water stop device and/or a cold-warm mixing device.

Yet another feature of the present invention includes the hand-held sprinkling rose having a throttling device at a water inlet.

Still further, the present invention includes the hand-held sprinkling rose wherein the individual rows of the outlet openings have different water-supplying pipelines, which can be blocked off individually.

The inventive core of the present invention is that, by means of a plurality of linearly disposed outlet openings, fine relatively hard water jets are produced, which are moved in comb fashion over the respective regions of hair, which are to be cleaned or rinsed. At the same time, the fine water jets, acting in comb fashion, penetrate at high speed deeply into the hair strands and rinse, for example, soap residues effectively from the hair. Compared to the state of the art, for which a considerably larger amount of water passes relatively unused over the hair and the bulk of the water is not used effectively for the cleaning process, the water of the present invention participates essentially completely in the cleaning process. A relatively small amount of water is used in a concentrated, linearly-acting manner with high efficiency for the cleaning process.

It is a feature of the invention that the individual water jets, upon leaving the outlet openings, do not mix with one another and, instead, penetrate as individual jets into the hair strands. It is a prerequisite for this that the outlet openings be a borehole of a relatively small diameter and that a shape of the borehole does not fan out or even atomize the emerging water jet. Individual diameters and number of outlet openings are advantageously selected so that special pressure generation is not necessary. Instead, usual water pressure in pipelines is sufficient. Outlet openings with a diameter between 0.3 and 0.8 mm have proven to be practicable.

The hand-held rose of the present invention has performed in an outstanding manner for the preferred application in the hairdressing trade. Compared to hand-held showers of the state of the art, water consumption has been reduced down to 20% while cleaning power is the same or better. Moreover, it is possible, in an advantageous manner, to treat individual strands or regions of hair exclusively. At the same time, a corresponding region of the scalp is massaged in a pleasant manner by the fine water jets.

Since the individual water networks frequently have very different pressures, it is advantageous to dispose an exchangeable or adjustable throttling device, such as an orifice plate, at the water inlet. With that, a velocity of the water emerging from the hand-held sprinkling rose is adjusted to a relatively stable value. It is therefore not necessary to spend much time to regulate the water supply. Instead, it is sufficient to turn a water tap on or off in order to achieve the desired, constant emergence of water at all times.

An arrangement of outlet openings in two rows has proven to be particularly advantageous. It is, however, also possible to dispose the outlet openings in only one row or in three to five rows. In the case of only one row, the passage of water through each outlet opening should be increased correspondingly. In the case of four or more rows, the cleaning effect is slowly lost and the state of the art, for which the water, brought two-dimensionally onto the hair, runs off without the enhanced cleaning action on the hair, is approached once again.

Depending on the application, it may be advantageous if the water, supplied to the individual rows of the outlet openings, can be blocked off individually. With that, the emergence of water can be regulated alternately over one or several rows. It is also advantageous to provide a water stop valve and, optionally, a hot/cold regulating device at the hand-held sprinkling rose.

In practice, it has been observed that the hand-held sprinkling rose, conceived as a hair shower, can be used advantageously also for other cleaning tasks, the advantages of small water consumption and a high cleaning power occurring in the same manner. For example, workplaces for butchers or fish merchants, with surfaces of wood, stone or plastic, can be kept clean effectively in an simple manner. The fine water jets, striking the surface at high speed, have a high cleaning effect, while the surroundings do not become wet in an undesirable mariner. A particular advantage consists moreover therein that, at a relatively small distance from the water outlet, the fine water jets have lost their velocity due to the action of the atmosphere and thus cannot be sprayed far. The effective distance of the working surface from the water outlet is between a few centimeters and, at most, twenty to thirty centimeters.

In the handicraft and industrial areas also, abraded materials, dusts, chips, etc. can advantageously be removed and rinsed off.

It is moreover also possible to use cleaning agents instead of water as cleaning liquid.

The invention is described in greater detail below by means of an example.

DETAILED DESCRIPTION

Figure 1:
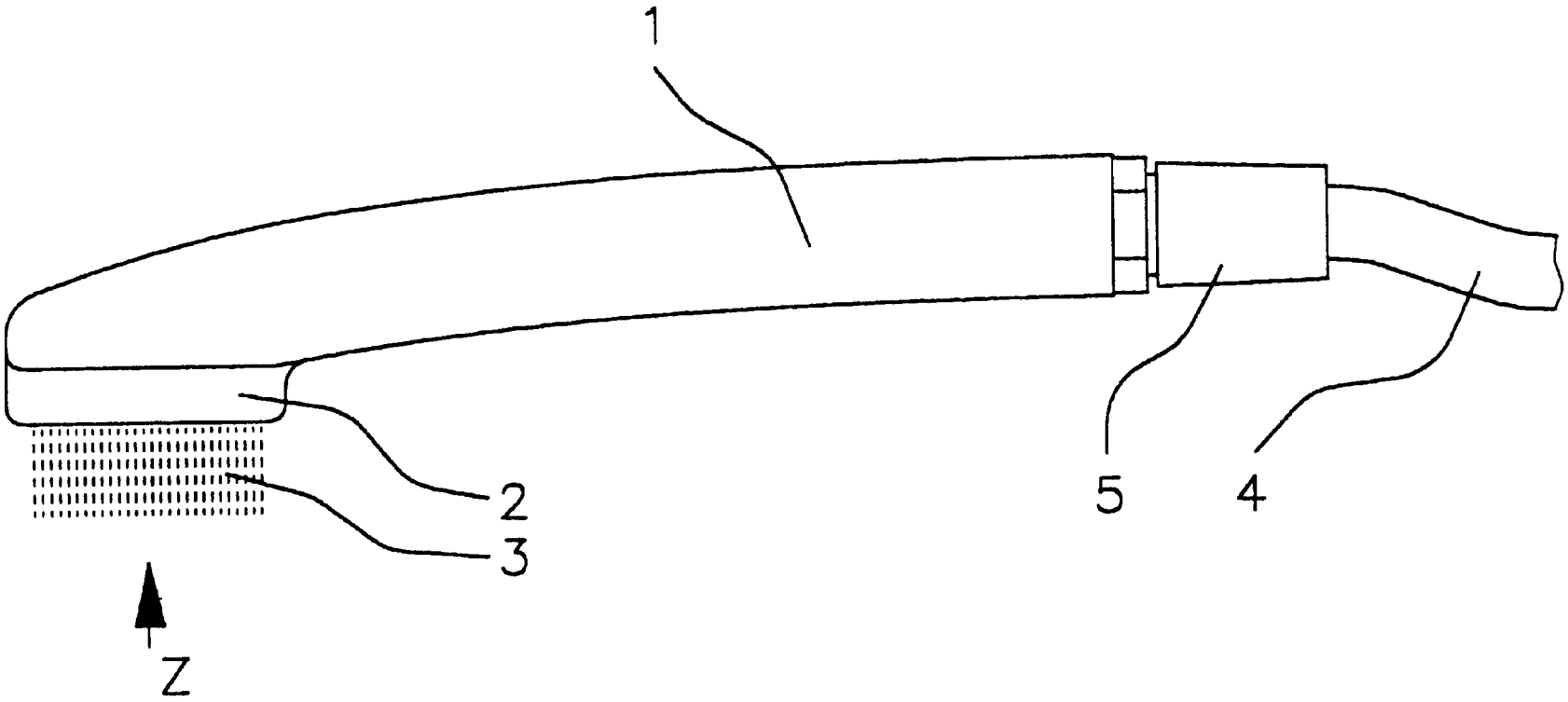
FIG. 1 shows side view of an embodiment of a hand-held sprinkling rose of the present invention.

Referring to FIG. 1, an embodiment of a hand-held sprinkling rose of the present invention is configured in with a handle 1, a sprinkling rose head 2, from which individual water jets 3 emerge during the operation of the rose 2, a hose 4, through which the water is supplied to the hand-held sprinkling rose, and a hose connection 5, by means of which the hose 4 is fastened to the handle 1.

Figure 2:
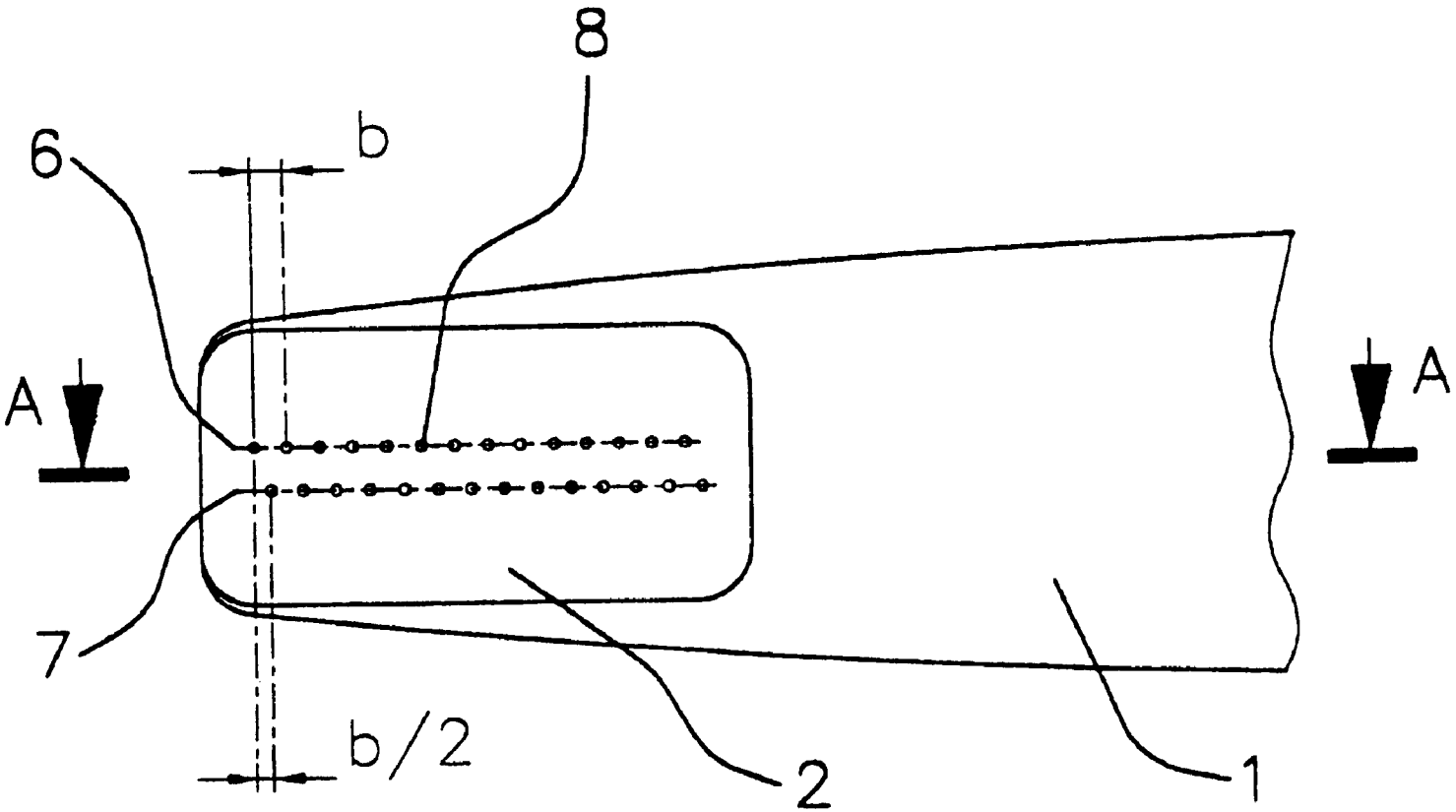
FIG. 2 shows a view the embodiment of FIG. 1 from the Z direction.

Referring to FIG. 2., the sprinkling rose head 2 is constructed in an elongated fashion and has outlet openings 8 disposed in two parallel rows 6 and 7. The outlet opening 8 are disposed within a row with a distance of b from one another and the outlet openings 8 of row 6 are offset at a distance of b/2 from the outlet openings 8 of row 7. It is, however, also possible to dispose the outlet openings 8 relative to the longitudinal axis of the rows 6 and 7 at right angles to one another in the same transverse axis.

A length of the rows 6 and 7 with the outlet openings 8 depends on respective requirements and is about 50 mm in the example.

Figure 3:
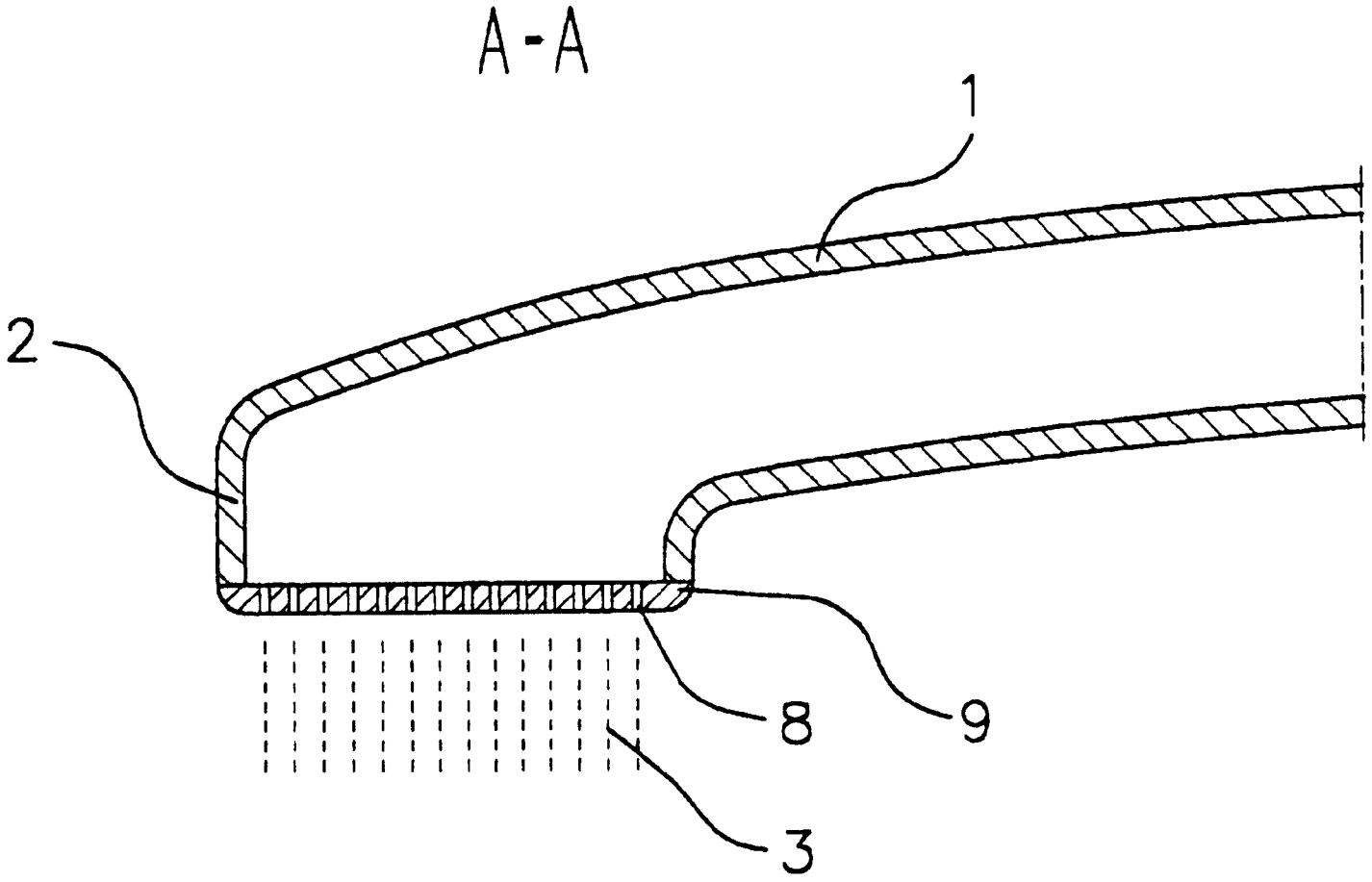
FIG. 3 shows cross-sectional view taken along section line A—A in FIG. 2.

Referring to FIG. 3, a cross section of the outlet openings 8 is a cylindrical borehole with sharp edges at the outlet openings 8. With that, water jets 3 are achieved which, in practice, flow out accurately linearly and do not expand or disintegrate apart significantly. In the example, a separate orifice plate 9 is attached to the sprinkling rose head 2.

With the hand-held sprinkling rose of the above embodiment, significant savings of water were achieved during testing. When the usual hand-held sprinkling rose of the state of the art was used, approximately 9 liters of water were consumed on the average for washing hair in a beauty salon. On the other hand, the water consumption when using the hand-held shower of the present invention was about 2 liters. In this connection, it is a special advantage that, for example, after individual strands of hair were colored, these could be rinsed separately and intensively without also wetting other regions of the hair in an undesirable manner.

Individual persons, whose hair was subjected to washing, emphasized that the fine, hard water jets brought about a pleasant massage of the scalp.

The invention obviously is not limited to the example described. For example, it is readily possible to construct the rows 6 and 7 in a slight arc, so that the line of water jets approximates the curvature of the human head when the hand-held sprinkling rose 2 is inclined by about 45°. In particular, it is also possible to configure the handle differently.

In addition, there may also be a water stop valve or a cold-warm mixing valve on the handle 1 in a known manner.

In handicraft and industrial operations, the "hand-held sprinkling rose" can also be disposed on a stationary and/or movable holding device, if the cleaning motion definitively is always the same.

What is claimed is:

1. A hand-held sprinkling rose for washing hair, comprising:

a sprinkling head having outlet openings disposed substantially linearly in a number of rows ranging from one to five;

the outlet openings having a diameter between 0.2 and 0.8 mm and the outlet openings being spaced apart a distance b in the range of 2 to 5 mm; and the outlet openings being formed such that water streams are ejected which do not mix with one another before reaching a work plane at least 20 centimeters from said sprinkling head.

2. The hand-held sprinkling rose of claim 1, wherein the outlet openings are disposed in two rows.

3. The hand-held sprinkling rose of one of claim 1 or 2, wherein the outlet openings are formed in at least two rows and adjacent ones of the outlet openings of adjacent ones of the at least two rows define axes to one another which are at an angle less than 90° to longitudinal axes of the at least two rows.

4. The hand-held sprinkling rose of one of claim 1 or 2, wherein a length of the rows is 20 to 100 mm.

5. A method of using the hand-held sprinkling rose of one of claim 1 or 3 comprising spraying a liquid for cleaning in one of a handicraft or an industrial environment, providing the liquid as a medium other than water.

6. The hand-held sprinkling rose of one of claim 1 or 2, wherein the outlet openings are formed in at least two rows and the outlet openings of adjacent ones of the at least two rows are offset relative to each other a distance equal to b/2.

7. A hand-held sprinkling rose for washing hair, comprising:

a sprinkling head having outlet openings disposed substantially linearly in a number of rows ranging from one to five;

the outlet openings having a diameter of 0.2 to 0.3 mm and the outlet openings being spaced apart a distance b in the range of 2 to 5 mm; and the outlet openings being formed such that water streams are ejected which do not mix with one another before reaching a work plane at least 20 centimeters from said sprinkling head.

8. The hand-held sprinkling rose of claim 7, wherein the outlet openings are disposed in two rows.

9. The hand-held sprinkling rose of one of claim 7 or 8, wherein the outlet openings are formed in at least two rows and ones of the outlet openings of adjacent ones of the at least two rows define axes to one another which are at an angle less than 90° to longitudinal axes of the at least two rows.

10. The hand-held sprinkling rose of one of claim 7 or 8, wherein a length of the rows is 20 to 100 mm.

11. The hand-held sprinkling rose of one of claim 10, wherein the diameter of the outlet openings is 0.2 mm.

12. The hand-held sprinkling rose of one of claim 10, wherein the diameter of the outlet openings is 0.3 mm.

13. A method of using the hand-held sprinkling rose of one of claim 7 or 8 comprising spraying a liquid for cleaning in one of a handicraft or an industrial environment, providing the liquid as a medium other than water.

14. The hand-held sprinkling rose of one of claim 7, wherein the diameter of the outlet openings is 0.2 mm.

15. The hand-held sprinkling rose of one of claim 7, wherein the diameter of the outlet openings is 0.3 mm.

16. The hand-held sprinkling rose of claim 7, wherein the outlet openings are formed in at least two rows and the outlet openings of adjacent ones of the at least two rows are offset relative to each other a distance equal to b/2.

* * * * *